US011856378B2

(12) United States Patent
Liao et al.

(10) Patent No.: US 11,856,378 B2
(45) Date of Patent: Dec. 26, 2023

(54) SYSTEM WITH SOUND ADJUSTMENT CAPABILITY, METHOD OF ADJUSTING SOUND AND NON-TRANSITORY COMPUTER READABLE STORAGE MEDIUM

(71) Applicant: HTC Corporation, Taoyuan (TW)

(72) Inventors: Chun-Min Liao, Taoyuan (TW); Tsung-Yu Tsai, Taoyuan (TW); Chi-Tang Ho, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 17/456,595

(22) Filed: Nov. 26, 2021

(65) Prior Publication Data

US 2023/0171542 A1 Jun. 1, 2023

(51) Int. Cl.

| | |
|---|---|
| ***H04R 3/04*** | (2006.01) |
| ***H04R 1/10*** | (2006.01) |
| ***H04S 7/00*** | (2006.01) |

(52) U.S. Cl.

CPC ..... *H04R 3/04* (2013.01); *H04R 1/1091* (2013.01); *H04S 7/304* (2013.01); *H04S 2420/01* (2013.01)

(58) Field of Classification Search

CPC ..... H04R 3/04; H04R 1/1091; H04S 7/304; H04S 2420/01

See application file for complete search history.

(56) References Cited

U.S. PATENT DOCUMENTS

| | | | | |
|---|---|---|---|---|
| 5,917,916 | A * | 6/1999 | Sibbald | H04S 1/002 381/74 |
| 9,277,343 | B1 * | 3/2016 | Alexandrov | H04S 1/002 |
| 11,451,922 | B1 * | 9/2022 | Moses | H04R 5/033 |
| 2014/0334657 | A1 * | 11/2014 | Guenther | H04R 5/0335 381/370 |
| 2016/0366502 | A1 * | 12/2016 | Morris | H04R 1/1066 |
| 2017/0078821 | A1 * | 3/2017 | Faller | H04S 1/002 |

(Continued)

FOREIGN PATENT DOCUMENTS

| | | |
|---|---|---|
| CN | 106507253 A | 3/2017 |
| CN | 111474710 A | 7/2020 |

(Continued)

OTHER PUBLICATIONS

Corresponding Taiwan office action dated Feb. 22, 2023.

*Primary Examiner* — Daniel R Sellers
(74) *Attorney, Agent, or Firm* — CKC & Partners Co., LLC

(57) ABSTRACT

A system with sound adjustment capability is provided. The system includes a head-mounted device, a first loudspeaker and a processor. The first loudspeaker is detachable from the head-mounted device. The processor is configured to detect a plurality of positions and a plurality of orientations of the head-mounted device and the first loudspeaker to determine whether the first loudspeaker is detached from the head-mounted device. The processor is further configured to modify a first audio signal by at least one first filter or at least one second filter to generate a filtered first audio signal. The at least one first filter is used when the first loudspeaker is coupled to the head-mounted device, and the at least one second filter is used when the first loudspeaker is detached from the head-mounted device. The filtered first audio signal is configured to drive the first loudspeaker.

21 Claims, 8 Drawing Sheets

(56) References Cited

U.S. PATENT DOCUMENTS

| | | | | |
|---|---|---|---|---|
| 2018/0020312 | A1* | 1/2018 | Visser | G06F 3/017 |
| 2019/0387299 | A1* | 12/2019 | Evans | G06F 3/04815 |
| 2020/0021940 | A1* | 1/2020 | Choueiri | H04R 5/02 |
| 2020/0103513 | A1* | 4/2020 | Knaappila | H04B 17/27 |
| 2020/0245047 | A1* | 7/2020 | Ou | H04R 3/12 |
| 2020/0372766 | A1 | 11/2020 | Biggs | |

FOREIGN PATENT DOCUMENTS

| | | | |
|---|---|---|---|
| TW | I687106 | B | 3/2020 |
| TW | 202127916 | A | 7/2021 |
| TW | 202147300 | A | 12/2021 |

* cited by examiner

SYSTEM WITH SOUND ADJUSTMENT CAPABILITY, METHOD OF ADJUSTING SOUND AND NON-TRANSITORY COMPUTER READABLE STORAGE MEDIUM

BACKGROUND

Technical Field

The present disclosure relates to processing of the audio signal. More particularly, the present disclosure relates to a system with sound adjustment capability, a method of adjusting sound and a non-transitory computer readable storage medium.

Description of Related Art

Virtual reality (VR) is a technology of using a computer to simulate a three-dimensional virtual world providing the user with visual, auditory, tactile and other sensory simulations. Headphones are commonly incorporated in VR devices to provide immersive binaural audio effects. However, not only sounds of the real world are blocked by the headphone, but also other people cannot hear sounds the headphone provided to the user, which makes the communication between the user and the user's colleagues or teammates become difficult.

SUMMARY

The disclosure provides a system with sound adjustment capability. The system includes a head-mounted device, a first loudspeaker and at least one processor. The first loudspeaker is detachable from the head-mounted device. The at least one processor is configured to detect a plurality of positions and a plurality of orientations of the head-mounted device and the first loudspeaker to determine whether the first loudspeaker is detached from the head-mounted device. The at least one processor is further configured to modify a first audio signal by at least one first filter or at least one second filter to generate a filtered first audio signal. The at least one processor uses the at least one first filter in response to that the first loudspeaker is coupled to the head-mounted device, and uses the at least one second filter in response to that the first loudspeaker is detached from the head-mounted device. The filtered first audio signal is configured to be transmitted to the first loudspeaker to drive the first loudspeaker.

The disclosure provides a method of adjusting sound. The method is applicable to a system including a head-mounted device and a first loudspeaker detachable from the head-mounted device, and includes the following operations: detecting a plurality of positions and a plurality of orientations of the head-mounted device and the first loudspeaker to determine whether the first loudspeaker is detached from the head-mounted device; modifying a first audio signal by at least one first filter or at least one second filter to generate a filtered first audio signal, in which the at least one first filter is used in response to that the first loudspeaker is coupled to the head-mounted device, and the at least one second filter is used in response to that the first loudspeaker is detached from the head-mounted device; and transmitting the filtered first audio signal to the first loudspeaker to drive the first loudspeaker.

The disclosure provides a non-transitory computer readable storage medium storing a plurality of computer readable instructions for controlling a system including at least one processor, a head-mounted device and a first loudspeaker detachable from the head-mounted device. The plurality of computer readable instructions, when being executed by the at least one processor, cause the at least one processor to perform: detecting a plurality of positions and a plurality of orientations of the head-mounted device and the first loudspeaker to determine whether the first loudspeaker is detached from the head-mounted device; modifying a first audio signal by at least one first filter or at least one second filter to generate a filtered first audio signal, in which the at least one first filter is used in response to that the first loudspeaker is coupled to the head-mounted device, and the at least one second filter is used in response to that the first loudspeaker is detached from the head-mounted device; and transmitting the filtered first audio signal to the first loudspeaker to drive the first loudspeaker.

It is to be understood that both the foregoing general description and the following detailed description are by examples, and are intended to provide further explanation of the disclosure as claimed.

DETAILED DESCRIPTION

Figure 1:
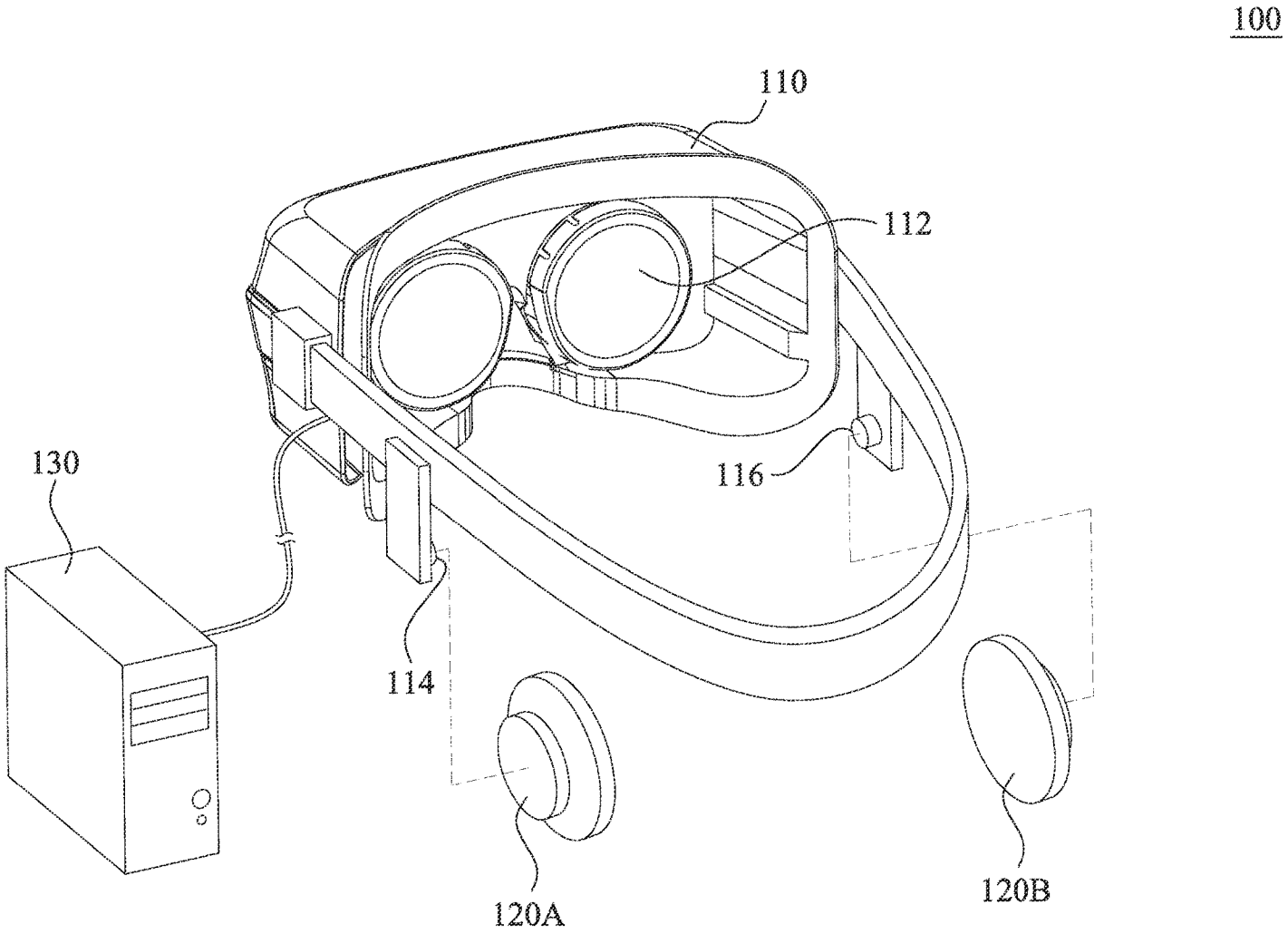
FIG. 1 is a schematic side view of a system with sound adjustment capability according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a schematic side view of a system 100 with sound adjustment capability, according to an embodiment of the present disclosure. The system 100 comprises a head-mounted device 110, a first loudspeaker 120A, a second loudspeaker 120B and a control device 130 comprising at least one processor. In this embodiment, the head-mounted device 110 is an augmented reality (AR) device and/or a virtual reality (VR) device, which includes a display module 112 to project virtual objects into the visual field of the user in AR applications and/or to provide immersive virtual environment to the user in VR applications. The head-mounted device 110 may also be implemented by a headband portion of a headphone in some embodiments.

The first loudspeaker 120A and the second loudspeaker 120B are coupled to the head-mounted device 110 on opposite first and second terminals 114 and 116 of the head-mounted device 110, respectively, and are detachable from the head-mounted device 110. In the situation that the first loudspeaker 120A and the second loudspeaker 120B are coupled to the head-mounted device 110, the first loudspeaker 120A and the second loudspeaker 120B are configured to be positioned at locations corresponding to entrances of a user's left and right ear canals. On the other hand, when the first loudspeaker 120A and the second loudspeaker 120B are detached from the head-mounted device 110, the first loudspeaker 120A and the second loudspeaker 120B are operated as speakers capable of providing stereo sounds to the user wearing the head-mounted device 110.

Figure 2:
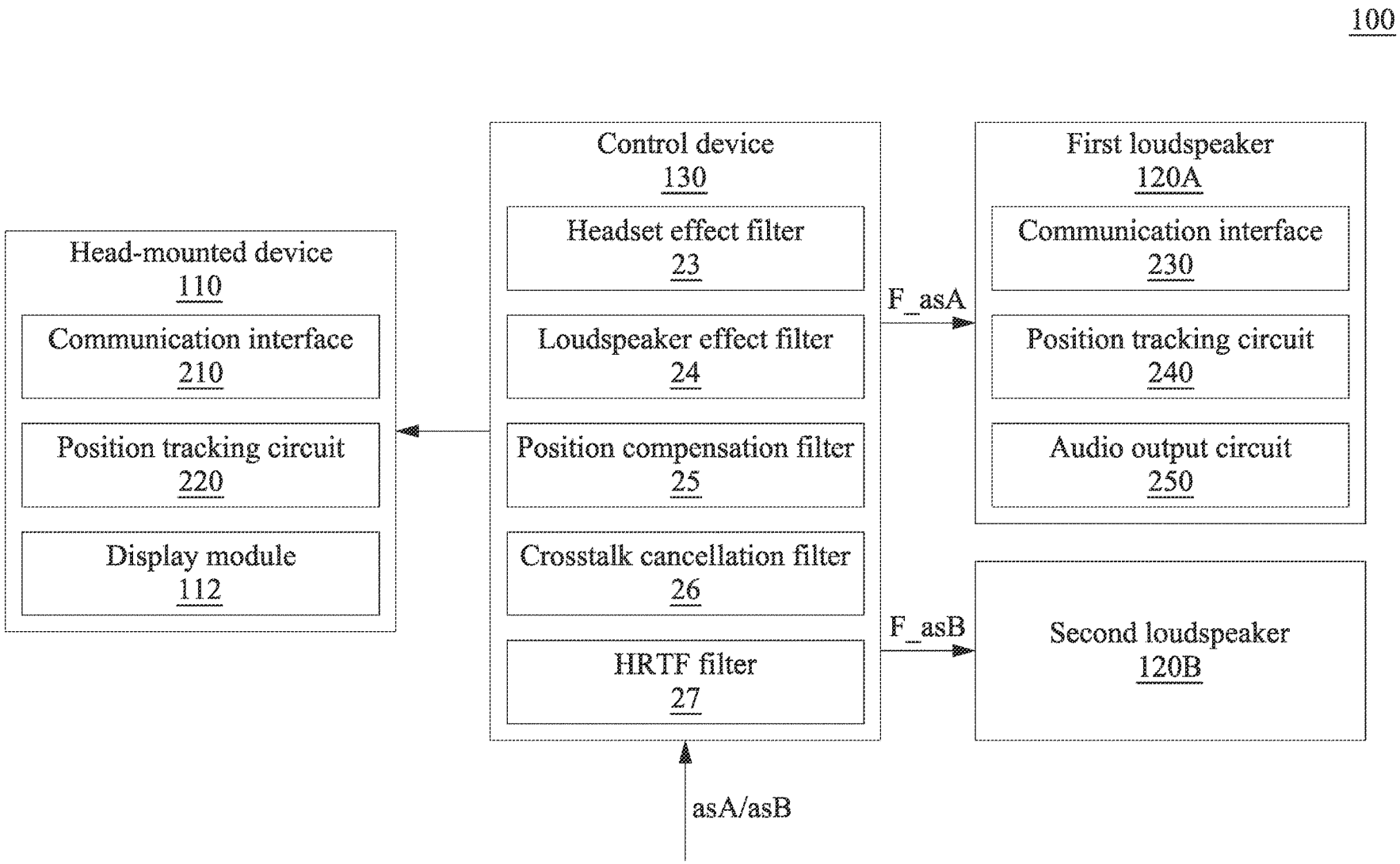
FIG. 2 is a simplified functional block diagram of the system of FIG. 1 according to an embodiment of the present disclosure.

The control device 130 is configured to provide video signal to the head-mounted device 110 to drive the display module 112, and to modify a first audio signal asA and a second audio signal asB (depicted in FIG. 2). The said modification may be applying filters to the first audio signal asA and second audio signal and asB to generate a filtered first audio signal F_asA and a filtered second audio signal and F_asB for driving the first loudspeaker 120A and the second loudspeaker 120B, respectively. The filtering process carried out by the control device 130 is described in detail in the later mentioned paragraphs. The control device 130 may be central processing units (CPUs), digital signal processors (DSPs), application specific integrated circuits (ASICs), field programmable gate arrays (FPGAs) or other programmable logic devices. In some embodiments, the control device 130 may comprise one or more components that are partially or wholly incorporated into the head-mounted device 110, that is, the head-mounted device 110 may be an all-in-one head-mounted device with sufficient computing capability.

FIG. 2 is a simplified functional block diagram of the system 100 according to an embodiment of the present disclosure. The head-mounted device 110 comprises a communication interface 210, a position tracking circuit 220 and the display module 112. The head-mounted device 110 is communicatively coupled with the control device 130 through the communication interface 210 to receive the video signal. The position tracking circuit 220 is configured to generate position information and orientation information to be processed by the control device 130 so that the control device 130 can determine the exact position and orientation of the head-mounted device 110 in a physical environment.

The first loudspeaker 120A and the second loudspeaker 120B are similar to each other, and therefore only the components and connection relationships of the first loudspeaker 120A are described in detail below. The first loudspeaker 120A comprises a communication interface 230, a position tracking circuit 240 and an audio output circuit 250. The communication interface 230 is configured to communicate with the control device 130 to receive the filtered first audio signal F_asA therefrom. In some embodiments, the communication interface 230 is configured to communicate with the communication interface 210 of the head-mounted device 110 to indirectly receive the filtered first audio signal F_asA via the head-mounted device 110. The position tracking circuit 240 is configured to generate position information and orientation information to be processed by the control device 130 so that the control device 130 may determine the position and orientation of the first loudspeaker 120A relative to the head-mounted device 110. The audio output circuit 250 is configured to generate sounds according to the filtered first audio signal F_asA.

In some embodiments, the communication interfaces 210 and 230 may be wired or wireless interfaces, such as Bluetooth, ZigBee or Ethernet.

In some embodiments, the position tracking circuits 220 and 240 may comprise a plurality of optical sensors configured to sense invisible light (e.g., the infrared light) emitted by a plurality of base stations (e.g., the lighthouses) arranged in the physical environment.

In other embodiments, the position tracking circuits 220 and 240 may be radio-frequency (RF) transceivers suitable for ultra-wideband positioning. For example, the position tracking circuits 220 and 240 may communicate with each other by ultra-wideband signals, so that the position and orientation of the first loudspeaker 120A relative to the head-mounted device 110 can be obtained by the time-of-flight method.

The control device 130 is configured to receive the first audio signal asA and the second audio signal asB, in which the first audio signal asA and the second audio signal asB carry audio data of the first loudspeaker 120A and the second loudspeaker 120B, respectively. The control device 130 is further configured to apply one or more filters to the first audio signal asA and the second audio signal asB according to the connection status of the first loudspeaker 120A and the second loudspeaker 120B (i.e., coupled to or detached from the head-mounted device 110), in order to alter the first audio signal asA and the second audio signal asB at one or more frequencies. Such filters include, but are not limited to, a headphone effect filter 23, a loudspeaker effect filter 24, a position compensation filter 25, a crosstalk cancellation filter 26 and a head-related transfer function (HRTF) filter 27, which may be stored in a memory that can be accessed by the control device 130.

Figure 3:
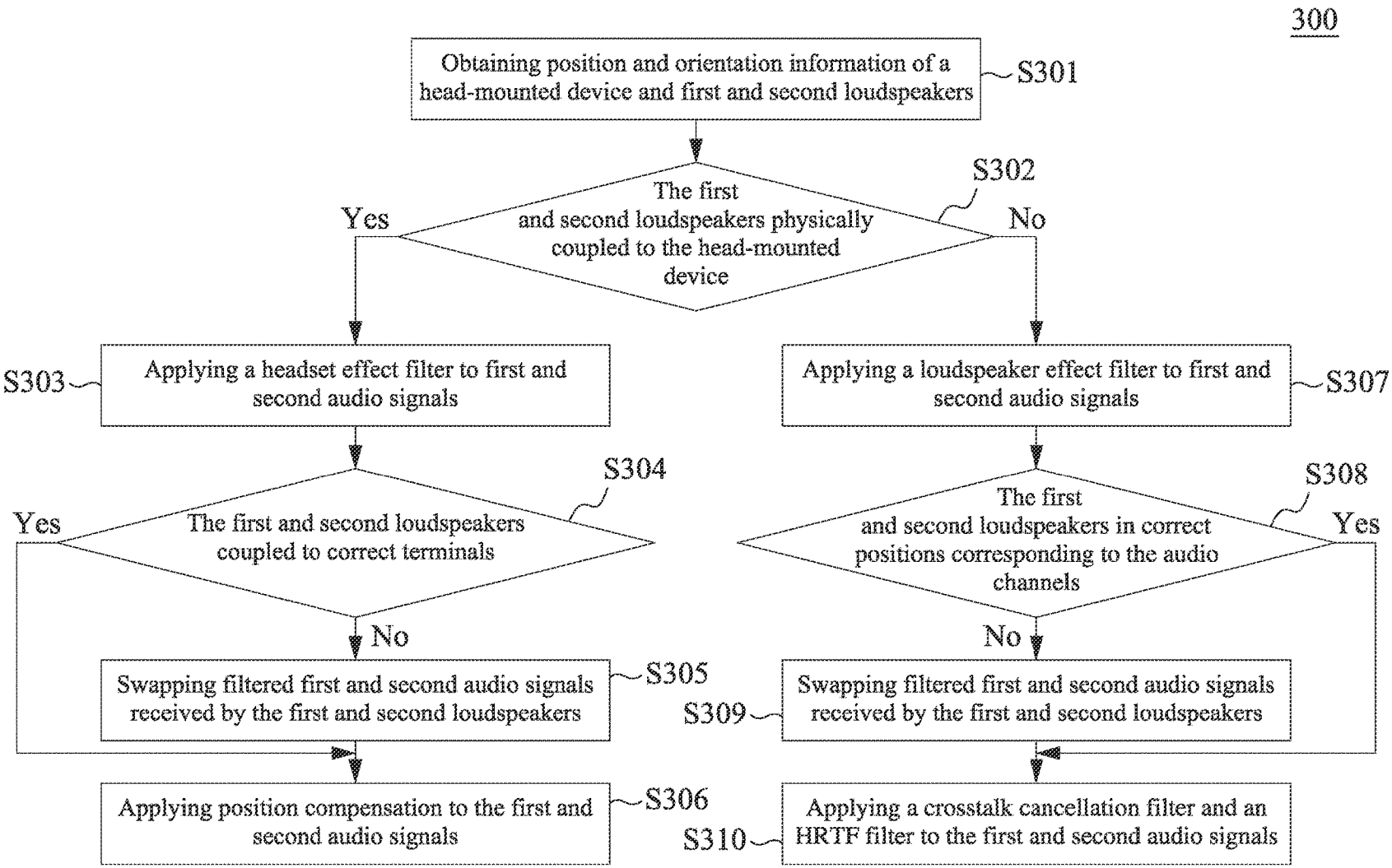
FIG. 3 is a flowchart illustrating a method of adjusting sound according to an embodiment of the present disclosure.

FIG. 3 is a flowchart illustrating a method 300 of adjusting sound according to an embodiment of the present disclosure. Any combination of the features of the method 300 or any of the other methods described herein may be embodied in instructions stored in a non-transitory computer readable medium. When executed, such as by the at least one processor of the control device 130 of FIG. 1, the instructions may cause some or all of such methods to be performed. It will be understood that any of the methods discussed herein may include greater or fewer operations than illustrated in the flowchart and the operations may be performed in any order, as appropriate.

In operation S301, position information and orientation information of the head-mounted device 110, the first loudspeaker 120A and the second loudspeaker 120B are obtained, for example, through the position tracking circuits 220 and 240. In some embodiments, one or more sensors, such as accelerometers and gyroscopes, may be incorporated in these devices of the system 100 in assistance to provide the orientation information.

In operation S302, it is determined that whether the first loudspeaker 120A and the second loudspeaker 120B are physically coupled to the head-mounted device 110. For example, the control device 130 may receive and process the position information and the orientation information to determine the positions of the first loudspeaker 120A and the second loudspeaker 120B relative to the head-mounted device 110. The control device 130 may select the filters to be applied to the first audio signal asA and the second audio signal asB according to the connection status of the first loudspeaker 120A and the second loudspeaker 120B.

If the first loudspeaker 120A and the second loudspeaker 120B are coupled to the head-mounted device 110 to form a headphone, operations S303-S306 may be conducted to apply at least one of the headphone effect filter 23 and the position compensation filter 25 to the first audio signal asA and the second audio signal asB. On the other hand, if the first loudspeaker 120A and the second loudspeaker 120B are detached from the head-mounted device 110 to be operated as speakers, operations S307-S310 may be conducted to apply at least one of the loudspeaker effect filter 24, the crosstalk cancellation filter 26 and the HRTF filter 27.

In operation S303, the headphone effect filter 23 is applied to the first audio signal asA and the second audio signal asB. The headphone effect filter 23 is configured to mitigate distortion of sounds generated by the first loudspeaker 120A and the second loudspeaker 120B coupled with the head-mounted device 110 (hereinafter referred to as the "headphone configuration"), in which the distortion is at least partially caused by the circuitry of the headphone configuration (i.e., a circuitry comprising the head-mounted device 110, the first loudspeaker 120A and the second loudspeaker 120B coupled with each other).

Figure 4:
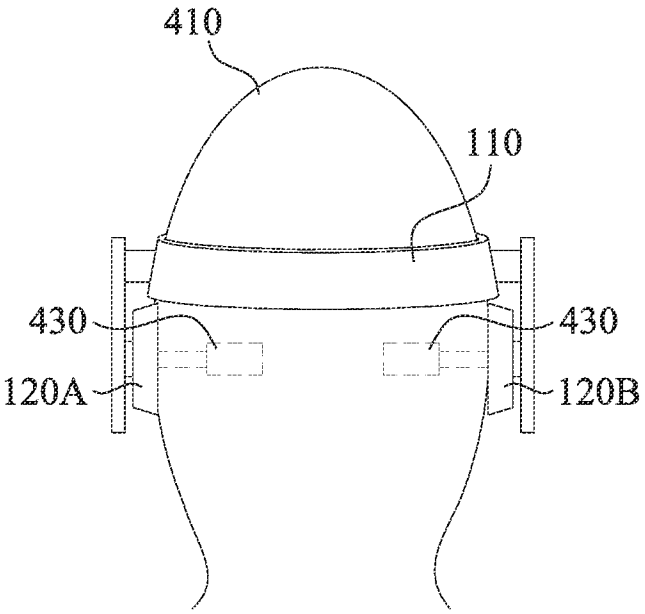
FIG. 4 is a schematic diagram of a frequency response of a headphone configuration worn on a dummy head, according to an embodiment of the present disclosure.
Figure 4:
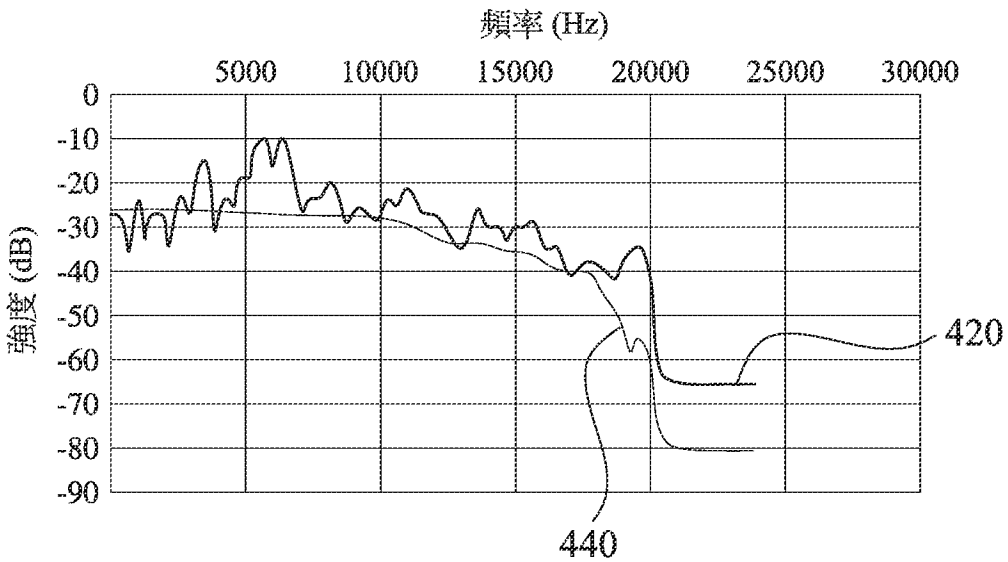
Figure 5:
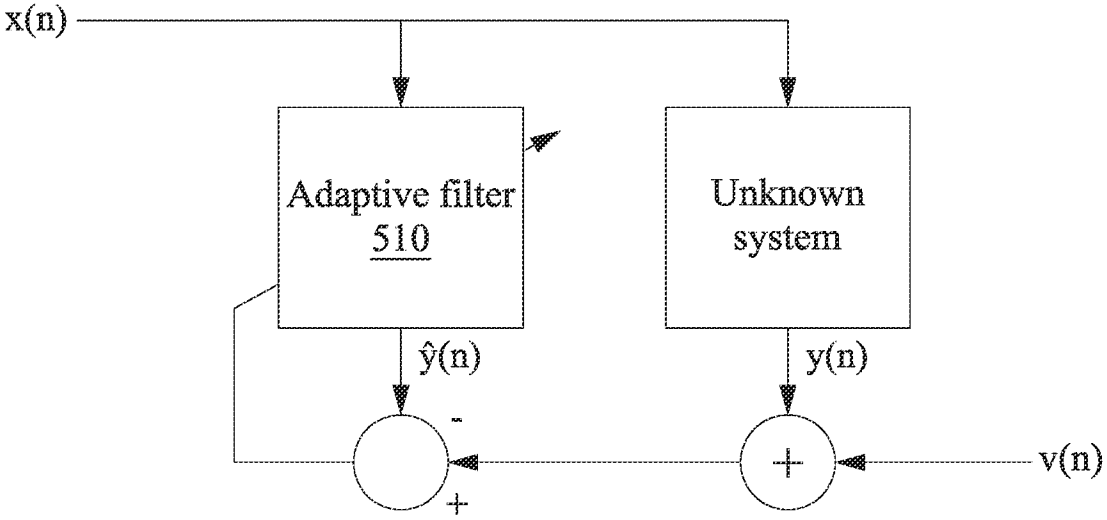
FIG. 5 shows an exemplary adaptive filter according to an embodiment of the present disclosure.

FIG. 4 is a schematic diagram of a frequency response of the headphone configuration worn on a dummy head 410, according to an embodiment of the present disclosure. FIG. 5 shows an exemplary adaptive filter 510 according to an embodiment of the present disclosure. Reference is made to FIG. 4 and FIG. 5 to illustrate an exemplary method of generating the headphone effect filter 23. First, the headphone configuration is worn on a dummy head 410, and a practical frequency response 420 of the first loudspeaker 120A is obtained through a sensor 430 in the left ear canal of the dummy head 410. Next, the practical frequency response 420 is inputted to the adaptive filter 510 as an input x(n) to adjust the coefficients of the adaptive filter 510. When the output $\hat{y}(n)$ of the adaptive filter 510 substantially matches an ideal frequency response 440 (represented by an ideal output y(n) in FIG. 5), the coefficients of the adaptive filter 510 are stored as coefficients for the first loudspeaker 120A in the headphone effect filter 23. The interference v(n) in FIG. 5 may be any undesired noises, such as the noise from the power supply. Coefficients for the second loudspeaker 120B in the headphone effect filter 23 may be obtained in a fashion similar to those described for the first loudspeaker 120A, and therefore those descriptions are omitted. In some embodiments, a neural network model may also be used to generate the headphone effect filter 23 by taking the practical frequency response 420 as an input of the neural network.

The first and second audio signals asA and asB filtered by the headphone effect filter 23 may be provided to the first and second loudspeakers 120A and 120B, respectively, as the filtered first and second audio signals F_asA and F_asB in some embodiments, or the first and second audio signals asA and asB may be further processed by one or more of operations S304-S306. By comparing the practical frequency response 420 with the ideal frequency response 440, it is appreciated that sounds generated based on the first and second audio signals asA and asB filtered by the headphone effect filter 23 have mitigated distortions at the entrances of the ear canals of the user compared to sounds generated based on unfiltered audio signals. In specific, the sounds generated based on the first and second audio signals asA and asB filtered by the headphone effect filter 23 have an enhanced (i.e., flattened) frequency response compared to the sounds generated based on the unfiltered audio signals.

In operation S304, whether the first loudspeaker 120A and the second loudspeaker 120B are coupled to correct terminals of the head-mounted device 110 is determined according to the position information and the orientation information. The control device 130 may check whether the positions of the first loudspeaker 120A and the second loudspeaker 120B correspond to the sound channels of the filtered first audio signal F_asA and the filtered second audio signal F_asA.

For example, the filtered first audio signal F_asA may correspond to a right channel, the control device 130 may check whether the first loudspeaker 120A is coupled to the second terminal 116 (e.g., the right terminal corresponding to the right channel. The filtered second audio signal F_asB may correspond to a left channel, the control device 130 may check whether the second loudspeaker 120B is coupled to the first terminal 114 (e.g., the left terminal corresponding to the left channel). If the determination result of operation S304 is "YES," operation 305 is omitted and operation S306 may be conducted. If the determination result of operation S304 is "NO" (e.g., the headphone configuration of FIG. 4 leads to the "NO" result), operation S305 may be conducted.

In operation S305, the filtered first audio signal F_asA and the filtered second audio signal F_asB received by the first loudspeaker 120A and the second loudspeaker 120B, respectively, may be swapped with each other. The control device 130 may, for example, transmit the filtered first audio signal F_asA previously transmitted to the first loudspeaker 120A to the second loudspeaker 120B, and transmit the filtered second audio signal F_asB previously transmitted to the second loudspeaker 120B to the first loudspeaker 120A. Accordingly, the system 100 allows the user to couple the first and second loudspeakers 120A and 120B to the head-mounted device 110 in an arbitrary manner without distorting the sound effect, realizing quick assembling of the headphone configuration to keep the immersive experience.

Figure 6:
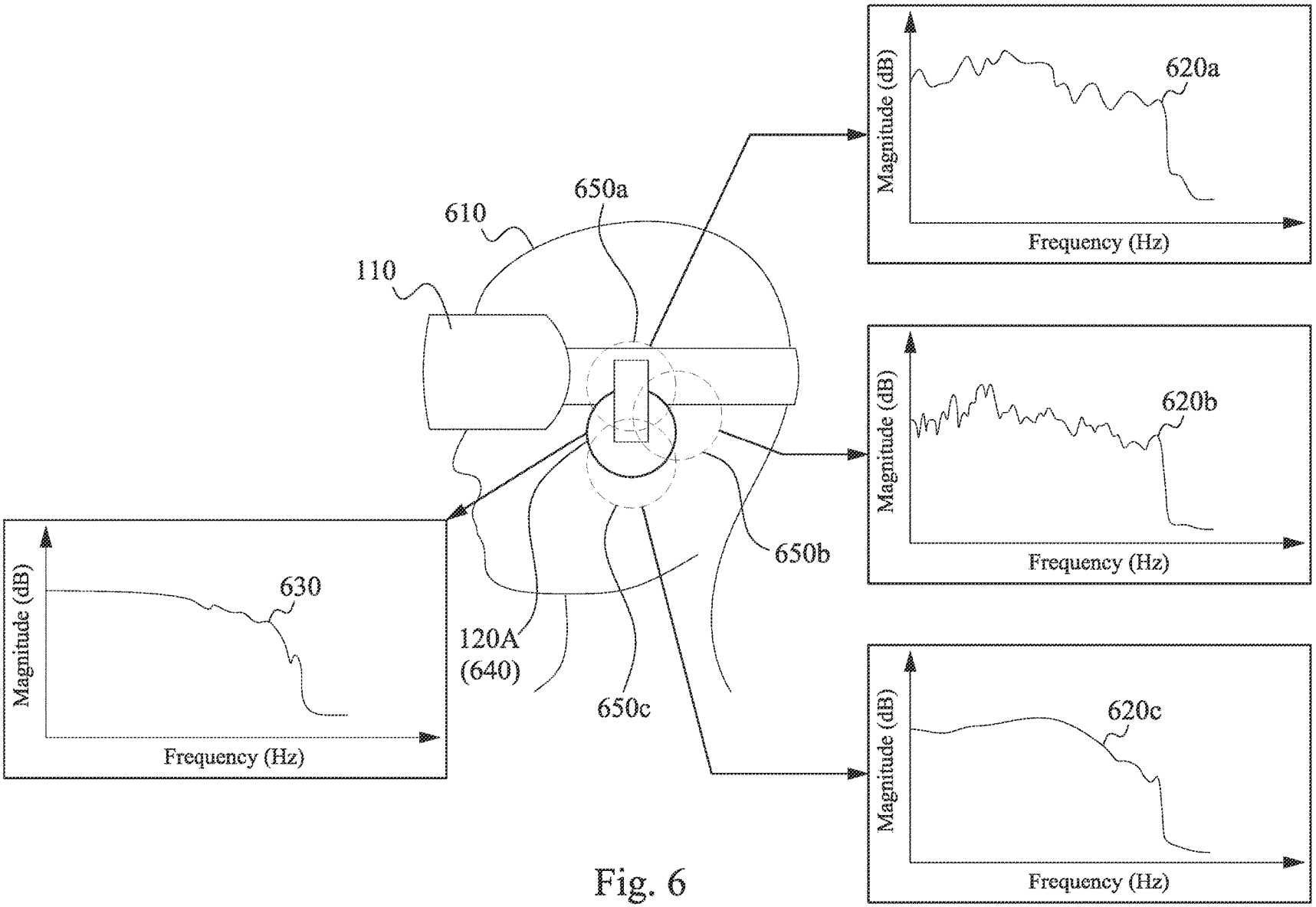
FIG. 6 is a schematic diagram of frequency responses of the headphone configuration worn on a user's head, according to an embodiment of the present disclosure.

In operation S306, position compensation may be applied on the first audio signal asA and the second audio signal asB which have been filtered by the headphone effect filter 23. FIG. 6 is a schematic diagram of frequency responses of the headphone configuration worn on the user's head 610, according to an embodiment of the present disclosure. Reference is made to FIG. 6 to illustrate an exemplary method of position compensation. First, the control device 130 may obtain a practical frequency response 620*a* of an echo of sounds generated by the first loudspeaker 120A based on a reference audio signal. Such echo may be received by an audio sensor (e.g., a microphone) of the first loudspeaker 120A. Next, if the practical frequency response 620*a* is substantially different from an ideal frequency response 630 stored in the memory accessible to the control device 130, the control device 130 may generate the position compensation filter 25 according to the practical frequency response 620*a* and the ideal frequency response 630, in which the position compensation filter 25 is configured to modify the reference signal at one or more frequencies to render such echo have a modified frequency response substantially the same as the ideal frequency response 630. Coefficients for the first loudspeaker 120A in the position compensation filter 25 may be generated by using an adaptive filter similar to the one discussed with reference to FIG. 5, but this disclosure is not limited thereto. In some embodiments, the position compensation filter 25 may be generated by a neural network by taking the practical frequency response 620*a* as an input of the neural network.

The ideal frequency response 630 can be seen as a frequency response obtained at an ideal position 640 corresponding to the entrance of the ear canal of the user, and the difference between the practical frequency response 620*a* and the ideal frequency response 630 is because of a position 650*a* of the first loudspeaker 120A deviated from the ideal position 640. As shown in FIG. 6, different positions 650*a*-650*c* of the first loudspeaker 120A may result the aforesaid echo having different practical frequency responses 620*a*-620*c*. Therefore, the control device 130 may adaptively adjust the coefficients for the first loudspeaker 120A in the position compensation filter 25 according to a current position of the first loudspeaker 120A. Coefficients for the second loudspeaker 120B in the position compensation filter 25 may be obtained in a fashion similar to those described for the first loudspeaker 120A, and therefore those descriptions are omitted.

The first and second audio signals asA and asB processed by operations S303-S306 are outputted by the control device 130 as the filtered first and second audio signals F_asA and F_asB, respectively. Accordingly, the user does not require to adjust the first and second loudspeakers 120A and 120B to absolutely correct positions in each time he/she couple the first and second loudspeakers 120A and 120B back to the head-mounted device 110, since the system 100 may automatically compensate the audio according to the user's wearing situation.

Reference is made to FIG. 3 again. The filtering process for the first loudspeaker 120A and the second loudspeaker 120B detached from the head-mounted device 110 (hereinafter referred to as the "speaker configuration") is described in detail below.

In operation S307, the loudspeaker effect filter 24 is applied to the first audio signal asA and the second audio signal asB. The loudspeaker effect filter 24 is configured to cancel distortions at least partially caused by a circuitry of the speaker configuration (e.g., a circuitry comprising the detached head-mounted device 110, the first loudspeaker 120A and the second loudspeaker 120B) to obtain flatten frequency responses. The coefficients for the first loudspeaker 120A in the loudspeaker effect filter 24 may be generated by an exemplary method including steps of (1) placing the first loudspeaker 120A in a unechoic chamber, (2) obtaining a practical frequency response of sounds generated by the first loudspeaker 120A, and (3) obtain filter coefficients for the first loudspeaker 120A by an adaptive filter similar to the one discussed with reference to FIG. 5 according to the practical frequency response and an ideal frequency response stored in the memory accessible to the control device 130.

Different distances between the user and the first loudspeaker 120A may cause different frequency responses, and may require different level of filtering. In some embodiments, multiple of sets of coefficients of the loudspeaker effect filter 24 may be generated by the above method, and the control device 130 may select a set of coefficients as the coefficients for the first loudspeaker 120A in the loudspeaker effect filter 24 according to a distance between the first loudspeaker 120A and the head-mounted device 110. Coefficients for the second loudspeaker 120B in the loudspeaker effect filter 24 may be generated in a similar fashion, and therefore those descriptions are omitted.

The first and second audio signals asA and asB filtered by the loudspeaker effect filter 24 may be provided to the first and second loudspeakers 120A and 120B, respectively, as the filtered first and second audio signals F_asA and F_asB in some embodiments, or the first and second audio signals asA and asB may be further processed by one or more of operations S308-S310.

Figure 7:
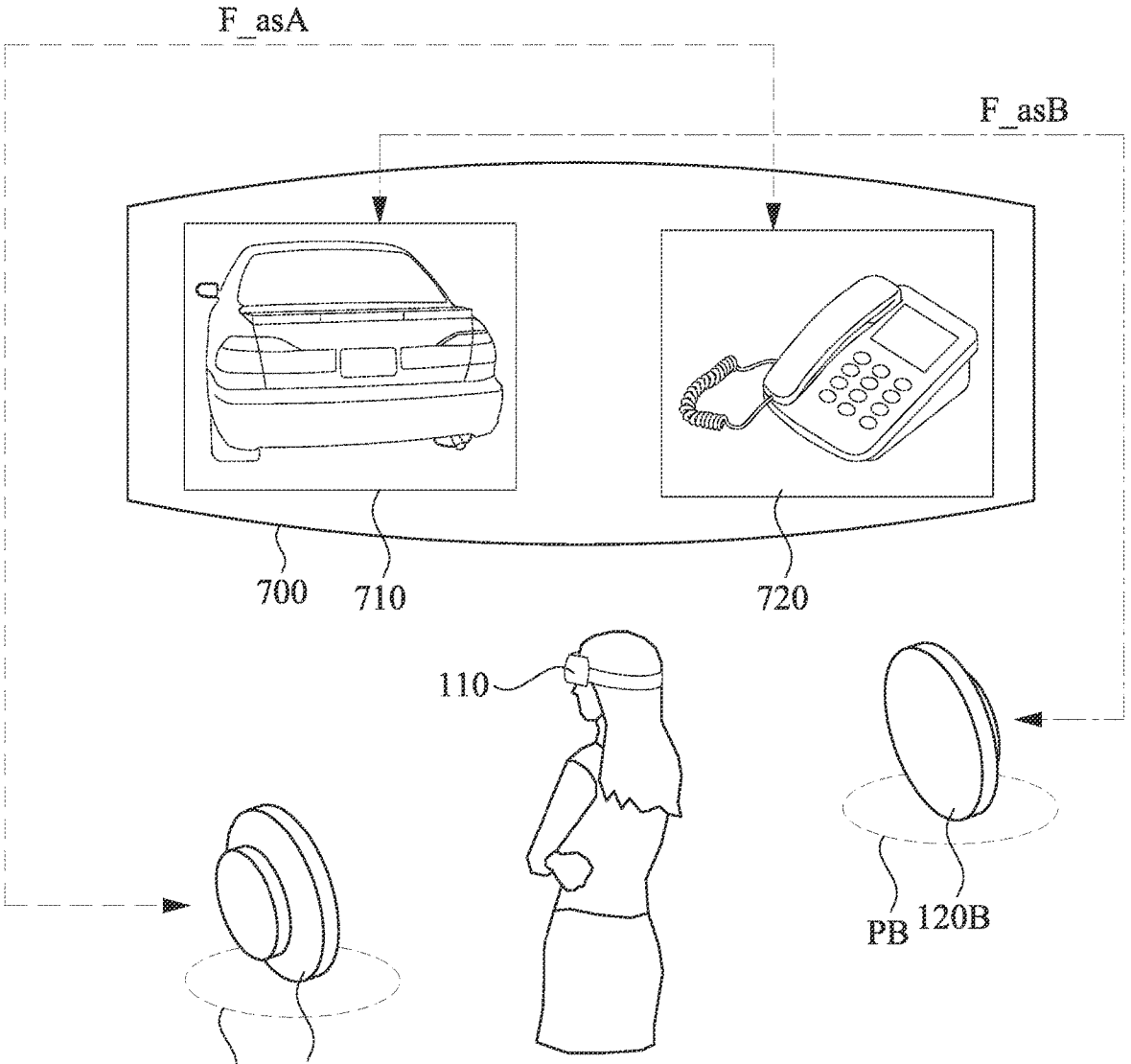
FIG. 7 shows an exemplary virtual environment provided by a head-mounted device of FIG. 1.

In operation S308, it is determined that whether the first loudspeaker 120A and the second loudspeaker 120B are in positions corresponding to the sound channels of the filtered first audio signal F_asA and the filtered second audio signal F_asB they received. FIG. 7 shows an exemplary virtual environment 700 provided by the head-mounted device 110 for illustrating operation S308. The filtered second audio signal F_asB may have a sound channel corresponding to a first virtual sound source 710 configured to be heard by the user as the first virtual sound source 710 is in a first position PA in the physical environment. The filtered first audio signal F_asA may have a sound channel corresponding to a second virtual sound source 720 configured to be heard by the user as the second virtual sound source 720 is in a second position PB in the physical environment. The head-mounted device 110 may be substantially in between the first position PA and the second position PB. In this situation, the control device 130 may check whether the first loudspeaker 120A corresponds to (e.g., approximates to) the second position PB specified by the filtered first audio signal F_asA, and whether the second loudspeaker 120B corresponds to (e.g., approximates to) the first position PA specified by the filtered second audio signal F_asB. If the determination result of operation S308 is "YES," operation S309 is omitted and operation S310 may be conducted. If the determination result of operation S308 is "NO" (e.g., the speaker configuration of FIG. 7 leads to the "NO" result), operation S309 may be conducted.

Figure 8:
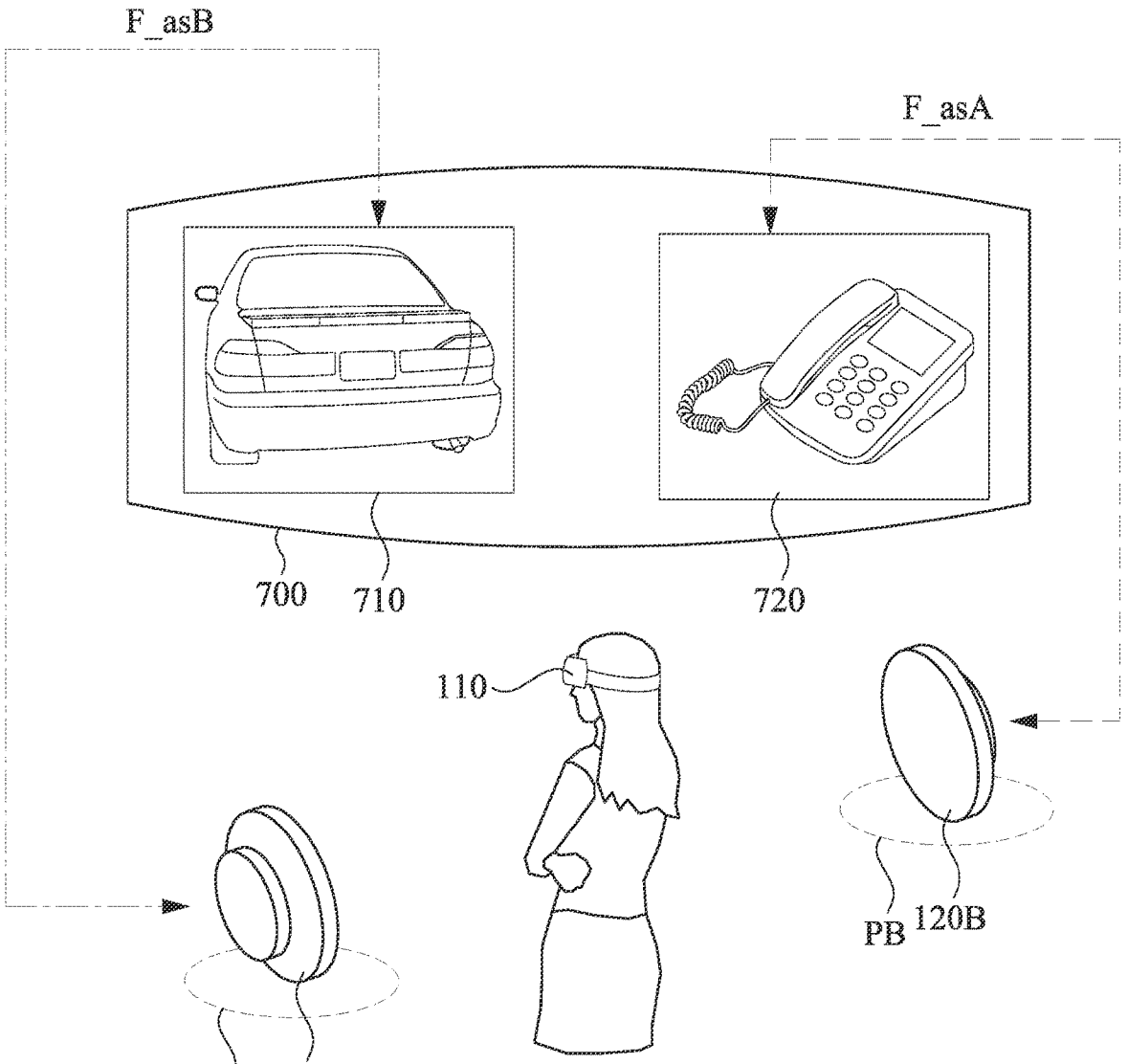
FIG. 8 shows another exemplary virtual environment provided by the head-mounted device of FIG. 1.

In operation S309, the filtered first audio signal F_asA and the filtered second audio signal F_asB received by the first loudspeaker 120A and the second loudspeaker 120B, respectively, may be swapped with each other. FIG. 8 shows the virtual environment 700 modified in operation S308. As shown in FIG. 8, the filtered first audio signal F_asA have the sound channel corresponding to the second position PB is transmitted to the second loudspeaker 120B in the second position PB instead of the first loudspeaker 120A. The filtered second audio signal F_asB has the sound channel corresponding to the first position PA is transmitted to the first loudspeaker 120A in the first position PA instead of the second loudspeaker 120B.

In operation S310, the crosstalk cancellation filter 26 and the HRTF filter 27 are applied to the first audio signal asA and the second audio signal asB filtered by the loudspeaker effect filter 24. The crosstalk cancellation filter 26 may render the first loudspeaker 120A and the second loudspeaker 120B act like they are in the headphone configuration to provide life-like binaural sounds. In the situation of FIG. 8, for example, the first loudspeaker 120A is at the user's left side, and the crosstalk cancellation filter 26 may reduce a portion transmitted to the user's right ear of the sounds of the first loudspeaker 120A. The HRTF filter 27 is configured to render sounds of the first loudspeaker 120A and the second loudspeaker 120B sound as if they are generated by the first loudspeaker 120A and the second loudspeaker 120B symmetrically placed in two sides of the head-mounted device 110.

Positions and orientations of a speaker relative to the user may influence the interaural time difference (ITD), the interaural level difference (ILD) and the frequency response. Therefore, in some embodiments, the control device 130 may obtain coefficients of the crosstalk cancellation filter 26 and the HRTF filter 27 according to the positions and orientations of the head-mounted device 110, the first loudspeaker 120A and the second loudspeaker 120B, by an adaptive filter similar to the one discussed with reference to FIG. 5.

The first and second audio signals asA and asB processed by operations S307-S310 may be outputted by the control device 130 as the filtered first and second audio signals F_asA and F_asB, respectively. Accordingly, the system 100 allows the user to place the first loudspeaker 120A and the second loudspeaker 120B in arbitrary positions and orientations without distorting the sound effect, realizing quick disposing of the speaker configuration to keep the immersive experience. In addition, the speaker configuration allows sounds of the physical environment to be heard by the user, and can broadcast sounds to other people, which helps to improve communication efficiency in various scenarios (e.g., meeting or gaming).

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the present disclosure will be apparent to those skilled in the art from consideration of the specification and practice of the present disclosure disclosed herein. It is intended that the specification and examples be considered as exemplary only, with a true scope and spirit of the present disclosure being indicated by the following claims.

What is claimed is:

1. A system with sound adjustment capability, comprising:

a head-mounted device, comprising a first position tracking circuit configured to generate first position information and first orientation information;

a first loudspeaker, comprising a second position tracking circuit configured to generate second position information and second orientation information, wherein the first loudspeaker is detachable from the head-mounted device; and at least one processor, configured to process the first position information, the second position information, the first orientation information and the second orientation information to determine a position and an orientation of the first loudspeaker relative to the head-mounted device, so as to determine whether the first loudspeaker is detached from the head-mounted device, and configured to modify a first audio signal by at least one first filter or at least one second filter to generate a filtered first audio signal, wherein the at least one first filter is used in response to that the first loudspeaker is coupled to the head-mounted device, and the at least one second filter is used in response to that the first loudspeaker is detached from the head-mounted device, wherein the filtered first audio signal is configured to be transmitted to the first loudspeaker to drive the first loudspeaker.

2. The system of claim 1, wherein the at least one processor is configured to modify the first audio signal at one or more frequencies to render sounds generated based on the filtered first audio signal by the first loudspeaker have an enhance frequency response at an entrance of an ear of a user compared to sounds generated based on an unfiltered audio signal by the first loudspeaker.

3. The system of claim 1, wherein the at least one first filter comprises a headphone effect filter for cancelling distortions at least partially caused by a circuitry comprising the head-mounted device and the first loudspeaker coupled to each other.

4. The system of claim 1, wherein the at least one second filter comprises a loudspeaker effect filter for cancelling distortions at least partially caused by a circuitry comprising the head-mounted device and the first loudspeaker detached from the head-mounted device.

5. The system of claim 4, wherein the at least one processor is configured to select coefficients for the first loudspeaker in the loudspeaker effect filter according to a distance between the first loudspeaker and the head-mounted device.

6. The system of claim 1, further comprising a memory, wherein in response to that the first loudspeaker is coupled to the head-mounted device, the at least one processor is configured to obtain a practical frequency response of an echo of sounds generated by the first loudspeaker based on a reference audio signal, in response to that the practical frequency response is substantially different from an ideal frequency response stored in the memory, the at least one processor is configured to apply a position compensation filter of the at least one first filter to the first audio signal, wherein the position compensation filter is configured to render the echo have a modified frequency response substantially same as the ideal frequency response.

7. The system of claim 1, further comprising a second loudspeaker detachable from the head-mounted device, wherein in response to that the first loudspeaker and the second loudspeaker are coupled to the head-mounted device on opposite first and second terminals of the head-mounted device, respectively, and in response to that the at least one processor determines that the filtered first audio signal has a sound channel corresponding to the second terminal, the at least one processor is configured to transmit a filtered second audio signal previously transmitted to the second loudspeaker to the first loudspeaker, and transmit the filtered first audio signal to the second loudspeaker.

8. The system of claim 1, further comprising a second loudspeaker detachable from the head-mounted device, wherein in response to that the first loudspeaker and the second loudspeaker are detached from the head-mounted device and respectively in a first position and a second position where the head-mounted device is substantially in between, and in response to that the at least one processor determines that the filtered first audio signal has a sound channel corresponding to the second position, the at least one processor is configured to transmit a filtered second audio signal previously transmitted to the second loudspeaker to the first loudspeaker, and transmit the filtered first audio signal to the second loudspeaker.

9. The system of claim 1, wherein the at least one second filter comprises a crosstalk cancellation filter and a head-related transfer function (HRTF) filter.

10. The system of claim 9, wherein the at least one processor is configured to obtain coefficients in the crosstalk cancellation filter and the HRTF filter according to the position and the orientation of the first loudspeaker relative to the head-mounted device.

11. The system of claim 1, wherein each of the first position tracking circuit and the second position tracking circuit comprises a plurality of optical sensors or a radio-frequency transceiver.

12. A method of adjusting sound, applicable to a system comprising a head-mounted device and a first loudspeaker detachable from the head-mounted device, wherein the head-mounted device comprises a first position tracking circuit configured to generate first position information and first orientation information, and the first loudspeaker comprises a second position tracking circuit configured to generate second position information and second orientation information, the method comprising:

processing the first position information, the second position information, the first orientation information and the second orientation information to determine a position and an orientation of the first loudspeaker relative to the head-mounted device, so as to determine whether the first loudspeaker is detached from the head-mounted device;

modifying a first audio signal by at least one first filter or at least one second filter to generate a filtered first audio signal, wherein the at least one first filter is used in response to that the first loudspeaker is coupled to the head-mounted device, and the at least one second filter is used in response to that the first loudspeaker is detached from the head-mounted device; and transmitting the filtered first audio signal to the first loudspeaker to drive the first loudspeaker.

13. The method of claim 12, wherein modifying the first audio signal comprises modifying the first audio signal at one or more frequencies to render sounds generated based on the filtered first audio signal by the first loudspeaker have an enhance frequency response at an entrance of an ear of a user compared to sounds generated based on an unfiltered audio signal by the first loudspeaker.

14. The method of claim 12, wherein the at least one first filter comprises a headphone effect filter for cancelling distortions at least partially caused by a circuitry comprising the head-mounted device and the first loudspeaker coupled to each other.

15. The method of claim 12, wherein the at least one second filter comprises a loudspeaker effect filter for cancelling distortions at least partially caused by a circuitry comprising the head-mounted device and the first loudspeaker detached from the head-mounted device.

16. The method of claim 15, wherein coefficients for the first loudspeaker in the loudspeaker effect filter are selected according to a distance between the first loudspeaker and the head-mounted device.

17. The method of claim 12, wherein the system further comprises a memory, and modifying the first audio signal comprises:

in response to that the first loudspeaker is coupled to the head-mounted device, obtaining a practical frequency response of an echo of sounds generated by the first loudspeaker based on a reference audio signal; and in response to that the practical frequency response is substantially different from an ideal frequency response stored in the memory, applying a position compensation filter of the at least one first filter to the first audio signal, wherein the position compensation filter is configured to render the echo have a modified frequency response substantially same as the ideal frequency response.

18. The method of claim 12, wherein the system further comprises a second loudspeaker detachable from the head-mounted device, and the method further comprises:

in response to that the first loudspeaker and the second loudspeaker are coupled to the head-mounted device on opposite first and second terminals of the head-mounted device, respectively, and in response to that the filtered first audio signal has a sound channel corresponding to the second terminal, transmitting a filtered second audio signal previously transmitted to the second loudspeaker to the first loudspeaker, and transmitting the filtered first audio signal to the second loudspeaker.

19. The method of claim 12, wherein the system further comprises a second loudspeaker detachable from the head-mounted device, and the method further comprises:

in response to that the first loudspeaker and the second loudspeaker are detached from the head-mounted device and respectively in a first position and a second position where the head-mounted device is substantially in between, and in response to that the filtered first audio signal has a sound channel corresponding to the second position, transmitting a filtered second audio signal previously transmitted to the second loudspeaker to the first loudspeaker, and transmitting the filtered first audio signal to the second loudspeaker.

20. The method of claim 12, wherein the at least one second filter comprises a crosstalk cancellation filter and a head-related transfer function (HRTF) filter.

21. A non-transitory computer readable storage medium, storing a plurality of computer readable instructions for controlling a system comprising at least one processor, a head-mounted device and a first loudspeaker detachable from the head-mounted device, wherein the head-mounted device comprises a first position tracking circuit configured to generate first position information and first orientation information, and the first loudspeaker comprises a second position tracking circuit configured to generate second position information and second orientation information, wherein the plurality of computer readable instructions, when being executed by the at least one processor, causing the at least one processor to perform:

processing the first position information, the second position information, the first orientation information and the second orientation information to determine a position and an orientation of the first loudspeaker relative to the head-mounted device, so as to determine whether the first loudspeaker is detached from the head-mounted device;

modifying a first audio signal by at least one first filter or at least one second filter to generate a filtered first audio signal, wherein the at least one first filter is used in response to that the first loudspeaker is coupled to the head-mounted device, and the at least one second filter is used in response to that the first loudspeaker is detached from the head-mounted device; and transmitting the filtered first audio signal to the first loudspeaker to drive the first loudspeaker.

* * * * *